US006195632B1

(12) United States Patent
Pearson

(10) Patent No.: US 6,195,632 B1
(45) Date of Patent: Feb. 27, 2001

(54) EXTRACTING FORMANT-BASED SOURCE-FILTER DATA FOR CODING AND SYNTHESIS EMPLOYING COST FUNCTION AND INVERSE FILTERING

(75) Inventor: Steve Pearson, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/200,335

(22) Filed: Nov. 25, 1998

(51) Int. Cl.[7] ..... G10L 11/00

(52) U.S. Cl. ..... 704/206; 704/220; 704/261

(58) Field of Search ..... 704/219, 220, 704/221–224, 229, 230, 205–209, 261–269

(56) References Cited

U.S. PATENT DOCUMENTS

| | | | | |
|---|---|---|---|---|
| Re. 32,124 | * | 4/1986 | Atal | 704/230 |
| 4,944,013 | * | 7/1990 | Gouvianakis et al. | 704/219 |
| 5,029,211 | * | 7/1991 | Ozawa | 704/266 |

OTHER PUBLICATIONS

"Automatic Formant Tracking by a Newton–Raphson Technique", J. P. Olive, The Journal of the Acoustical Society of America, vol. 50, No. 2, revised May 18, 1971, pp. 661–670.

"An Algorithm for Automatic Formant Extraction Using Linear Prediction Spectra", Stephanie S. McCandless, IEEE Transactions On Acoustics, Speech, and Signal Processing, vol. ASSP–22, No. 2, Apr. 1974, pp. 135–141.

Interactive Digital Inverse Filtering and Its Relation To Linear Prediction Methods:, Melvyn J. Hunt, John S. Bridle and John N. Holmes, Joint Speech Research Unit, IEEE, 1978, pp. 15–18.

"High Quality Glottal LPC–Vocoding", per Hedelin, Chalmers University of Technology, Department of Information Theory, S–412 96 Goteborg, Sweden, IEEE, 1986, pp. 465–468.

"Globally Optimising Formant Tracker Using Generalised Centroids", A. Crowe and M. A. Jack, Centre for Speech Technology Research, University of Edinburgh, United Kingdon, Aug. 7, 1987, pp. 1–2.

"Robust Arma Analysis As An Aid In Developing Parameter Control Rules For A Pole–Zero Cascade Speech Synthesizer", J. De Veth, W. van Golstein Brouwers, H. Loman, and L. Boves, Nijmegan University, PTT Research Neher Laboratories, The Netherlands, S6a.3, IEEE 1990, pp. 305–307.

"Design and Performance of an Analysis–by–Synthesis Class of Predictive Speech Coders", Richard C. Rose, Member IEEE, and Thomas P. Barnwell, III, Fellow IEEE, IEEE Transactions On Acoustics, Speech, and Signal Processing, vol. 38, No. 9, Sep. 1990, pp. 1489–1503.

"Glottal Wave Analysis with Pitch Synchronous Iterative Adaptive Inverse Filtering", Paavo Alku, Helsinki University of Technology, Acoustics Laboratory, Finland, Speech Communication 11, revised Jan. 23, 1992, pp. 109–118.

"Formant Location From LPC Analysis Data", Roy C. Snell, Member IEEE and Fausto Milinazzo, IEEE Transactions On Speech and Audio Processing, vol. 1, No. 2, Apr. 1993, pp. 129–134.

(List continued on next page.)

*Primary Examiner*—David D. Knepper
(74) *Attorney, Agent, or Firm*—Harness, Dickey & Pierce, P.L.C.

(57) ABSTRACT

An iterative formant analysis, based on minimizing the arc-length of various curves, and under various filter constraints estimates formant frequencies with desirable properties for text-to-speech applications. A class of arc-length cost functions may be employed. Some of these have analytic solutions and thus lend themselves well to applications requiring speed and reliability. The arc-length inverse filtering techniques are inherently pitch synchronous and are useful in realizing high quality pitch tracking and pitch epoch marking.

8 Claims, 6 Drawing Sheets

OTHER PUBLICATIONS

"Automatic Estimation Of Formant and Voice Source Parameters Using A Subspace Based Algorithm", Chang–heng Yang and Hideki Kasuya, Faculty of Engineering, Utsunomiya University, Japan, 1998, pp. 1–4.

"Estimation Of The Glottal Pulseform Based On Discrete All–Pole Modeling", Paavo Alku and Erkki Vilkman, Helsinki University of Technology and Helsinki University of Central Hospital, Finland, pp. 1–4.

"Inverse Filtering Of The Glottal Waveform Using The Itakura–Saito Distortion Measure", Paavo Alku, Helsinki University of Technology, Acoustics Laboratory, Finland, pp. 847–850.

"A Method Of Measuring Formant Frequencies At High Fundamental Frequencies", Hartmut Traunmuller, Dept. of Linguistics, Stockholm University, Sweden, and Anders Eriksson, Dept. of Phonetics, Umea University, Sweden, pp. 1–4.

"A Frequency Domain Method For Parametrization Of The Voice Source", Paavo Alku, University of Turku, Electronics and Information Technology, Finland, and Erkki Vilkman, University of Oulu, Dept. Otolaryngology and Phoniatrics, Finland, 1996, pp. 1569–1572.

"Robust Arma Analysis For Accurate Determination Of System Parameters Of The Voice Source and Vocal Tract", J. De Veth, W. van Golstein Brouwers, and L. Boves, Nijmegan University and PTT Research Neher Laboratories, The Netherlands, pp. 43–46.

"Evaluation Of A Glottal Arma Modelling Scheme", A. P. Lobo and W. A. Ainsworth, Dept. of Communication and Neuroscience, University of Keele, Keele, U.K. pp. 27–30.

"A New Glottal LPC Method Of Low Complexity For Speech Analysis and Coding", Paavo Alku, Unto K. Laine, Helsinki University of Technology, Finland, pp. 31–34.

"Fast Formant Estimation Of Children's Speech", A. A. Wrench and J. Laver, Centre for Speech Technology Research, University of Edinburgh, Scotland; J. M. M. Watson, Department of Speech Pathology and Therapy, Queen Margaret College, Scotland; D. S. Soutar, Plastic Surgery Unit, Glasgow; A. G. Robertson, Beatson Oncology Centre, Glasgow, pp. 1–4.

* cited by examiner

EXTRACTING FORMANT-BASED SOURCE-FILTER DATA FOR CODING AND SYNTHESIS EMPLOYING COST FUNCTION AND INVERSE FILTERING

BACKGROUND AND SUMMARY OF THE INVENTION

The present invention relates generally to speech and waveform synthesis. The invention further relates to the extraction of formant-based source-filter data from complex waveforms. The technology of the invention may be used to construct text-to-speech and music synthesizers and speech coding systems. In addition, the technology can be used to realize high quality pitch tracking and pitch epoch marking. The cost functions employed by the present invention can be used as discriminatory functions or feature detectors in speech labeling and speech recognition.

One way of analyzing and synthesizing complex waveforms, such as waveforms representing synthesized speech or musical instruments, is to employ a source-filter model. Using the source-filter model, a source signal is generated and then run through a filter that adds resonances and coloration to the source signal. The combination of source and filter, if properly chosen, can produce a complex waveform that simulates human speech or the sound of a musical instrument.

In source-filter modeling, the source waveform can be comparatively simple: white noise or a simple pulse train, for example. In such case the filter is typically complex. The complex filter is needed because it is the cumulative effect of source and filter that produces the complex waveform. Alternatively, the source waveform can be comparatively complex, in which case, the filter can be more simple. Generally speaking, the source-filter configuration offers numerous design choices.

We favor a model that most closely represents the natural occurring degree of separation between human glottal source and the vocal tract filter. When analyzing the complex waveform of human speech, it is quite challenging to ascertain which aspects of the waveform may be attributed to the glottal source and which aspects may be attributed to the vocal tract filter. It is theorized, and even expected, that there is an acoustic interaction between the vocal tract and the nature of the glottal waveform which is generated at the glottis. In many cases this interaction may be negligible, hence in synthesis it is common to ignore this interaction, as if source and filter are independent.

We believe that many synthesis systems fall short due to a source-filter model with a poor balance between source complexity and filter complexity. The source model is often dictated by ease of generation rather than the sound quality. For instance linear predictive coding (LPC) can be understood in terms of a source-filter model where the source tends to be white (i.e. flat spectrum). This model is considerably removed from the natural separation between human vocal tract and glottal source, and results in poor estimates of the first formant and many discontinuities in the filter parameters.

An approach heretofore taken as an alternative of LPC to overcome the shortcomings of LPC involves a procedure called "analysis by synthesis." Analysis by synthesis is a parametric approach that involves selecting a set of source parameters and a set of filter parameters, and then using these parameters to generate a source waveform. The source waveform is then passed through the corresponding filter and the output waveform is compared with the original waveform by a distance measure. Different parameter sets are then tried until the distance is reduced to a minimum. The parameter set that achieves the minimum is then used as a coded form of the input signal.

Although analysis by synthesis does a good job of optimizing a parametric voice source with a vocal tract modeling filter, it imposes a parametric source model assumption that is difficult to work with.

The present invention takes a different approach. The present invention employs a filter and an inverse filter. The filter has an associated set of filter parameters, for example, the center frequency and bandwidth of each resonator. The inverse filter is designed as the inverse of the filter (e.g. poles of one become zeros of the other and vice versa). Thus the inverse filter has parameters that bear a relationship to the parameters of the filter. A speech signal is then supplied to the inverse filter to generate a residual signal. The residual signal is processed to extract a set of data points that define a line or curve (e.g. waveform) that may be represented as plural segments.

Different processing steps may be employed to extract and analyze the data points, depending on the application. These processing steps include extracting time domain data from the residual signal and extracting frequency domain data from the residual signal, either performed separately or in combination with other signal processing steps.

The processing steps involve a cost calculation based on a length measure of the line or waveform which we term "arc-length." The arc-length or its square is calculated and used as a cost parameter associated with the residual signal. The filter parameters are then selectively adjusted through iteration until the cost parameter is minimized. Once the cost parameter is minimized, the residual signal is used to represent an extracted source signal. The filter parameters associated with the minimized cost parameter may also then be used to construct the filter for a source-filter model synthesizer.

Use of this method results in a smoothness or continuity in the output parameters. When these parameters are used to construct a source-filter model synthesizer, the synthesized waveform sounds remarkably natural, without distortions due to discontinuities. A class of cost functions, based on the arc-length measure, can be used to implement the invention. Several members of this class are described in the following specification. Others will be apparent to those skilled in the art.

For a more complete understanding of the invention, its objects and advantages, refer to the following specification and to the accompanying drawings.

DETAILED DESCRIPTION OF THE PREFERRED EMBODIMENTS

The techniques of the invention assume a source-filter model of speech production (or other complex waveform, such as a waveform produced by a musical instrument). The filter is defined by a filter model of the type having an associated set of filter parameters. For example, the filter may be a cascade of resonant IIR filters (also known as an all-pole filter). In such case the filter parameters may be, for example, the center frequency and bandwidth of each resonator in the cascade. Other types of filter models may also be used.

Often the filter model either explicitly or implicitly also includes a constraint that can be readily described in mathematical or quantitative terms. An example of such constraint occurs when a measurable quantity remains constant even while filter parameters are changed to any of their possible values. Specific examples of such constraints include:

(1) energy is conserved when passing through the filter, (2) a DC signal is passed through unchanged (i.e., a DC gain of 1), or more generally, (3) the filters transfer function, H(z), is always 1 at some given point in the Z-plane.

The present invention employs a cost function designed to favor properties of a real source. In the case of speech, the real source is a pressure wave associated with the glottal source during voicing. It has properties of continuity, Quasi-periodicity, and often, a concentration point (or pitch epoch) when the glottis snaps shut momentarily between each opening of the glottis. In the case of a musical instrument, the real source might be the pressure wave associated with a vibrating reed in a wind instrument, for example.

The most important property that our cost function attempts to quantify is the presence of resonances induced by the vocal tract or musical instrument body. The cost function is applied to the residual of the inverse filtering of the original speech or music signal. As the inverse filter is adjusted iteratively, a point will be reached where the resonances have been removed, and correspondingly the cost function will be at a minimum. The cost function should be sensitive to resonances induced by the vocal tract or instrument body, but should be insensitive to the resonances inherent in the glottal source or instrument sound source, This distinction is achievable since only the induced resonances cause an oscillatory perturbation in the residual time domain waveform or extraneous excursions in the frequency domain curve. In either case, we detect an increase in the arc-length of the waveform or curve. In contrast. LPC does not make this distinction and thus uses parts of the filter to model glottal source or instrument sound source characteristics.

Figure 1:
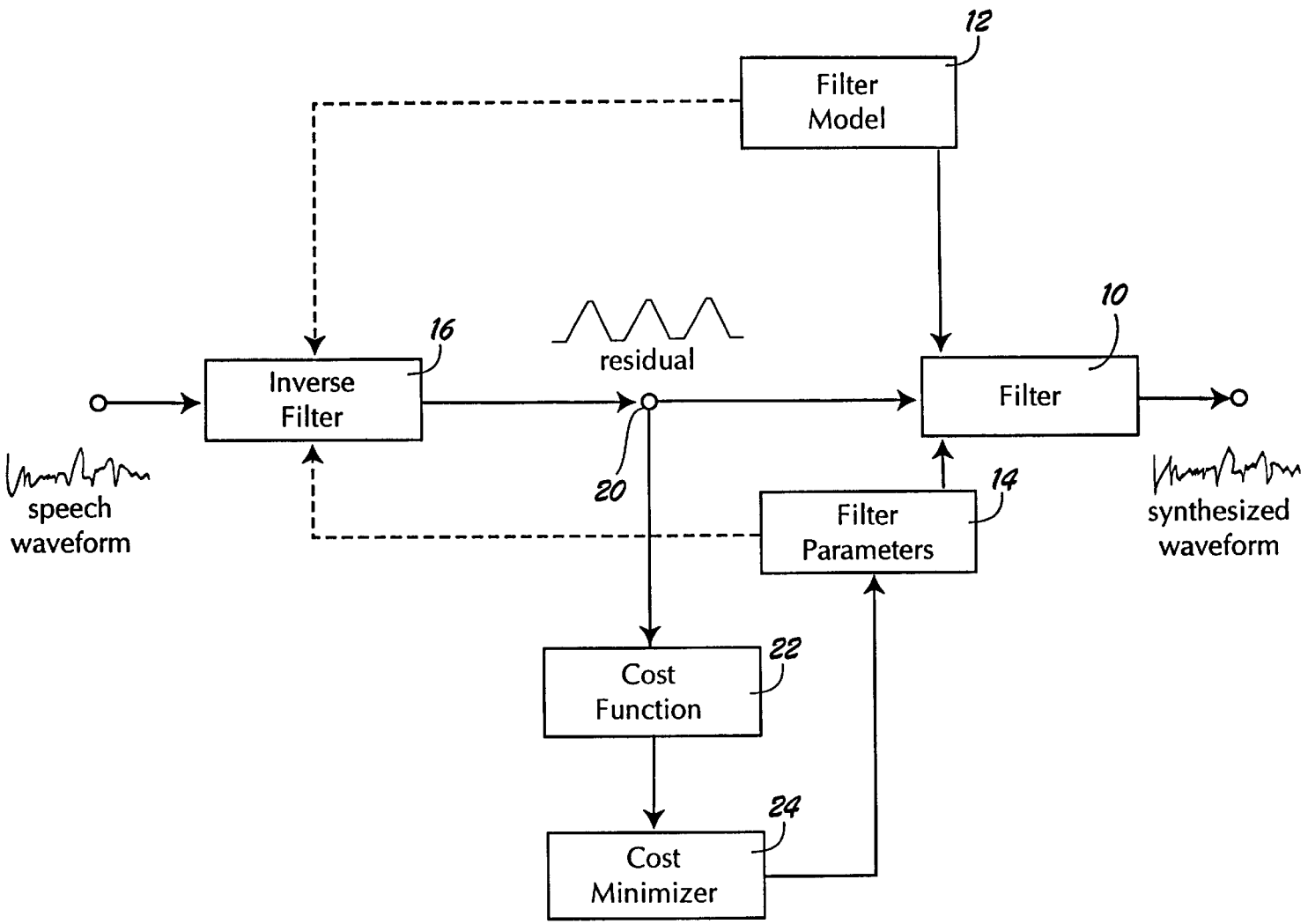
FIG. 1 is a block diagram of the presently preferred apparatus useful in practicing the invention.

FIG. 1 illustrates a system according to the invention by which the source waveform may be extracted from a complex input signal. A filer/inverse-filter pair are used in the extraction process.

In FIG. 1, filter 10 is defined by its filter model 12 and filter parameters 14. The present invention also employs an inverse filter 16 that corresponds to the inverse of filter 10. Filter 16 would, for example, have the same filter parameters as filter 10, but would substitute zeros at each location where filter 10 has poles. Thus the filter 10 and inverse filter 16 define a reciprocal system in which the effect of inverse filter 16 is negated or reversed by the effect of filter 10. Thus, as illustrated, a speech waveform input to inverse filter 16 and subsequently processed by filter 10 results in an output waveform that, in theory, is identical to the input waveform. In practice, slight variations in filter tolerance or slight differences between filters 16 and 10 would result in an output waveform that deviates somewhat from the identical match of the input waveform.

When a speech waveform (or other complex waveform) is processed through inverse filter 16, the output residual signal at node 20 is processed by employing a cost function 22. Generally speaking, this cost function analyzes the residual signal according to one or more of a plurality of processing functions described more fully below, to produce a cost parameter. The cost parameter is then used in subsequent processing steps to adjust filter parameters 14 in an effort to minimize the cost parameter. In FIG. 1 the cost minimizer block 24 diagrammatically represents the process by which filter parameters are selectively adjusted to produce a resulting reduction in the cost parameter. This may be performed iteratively, using an algorithm that incrementally adjusts filter parameters while seeking the minimum cost.

Once the minimum cost is achieved, the resulting residual signal at node 20 may then be used to represent an extracted source signal for subsequent source-filter model synthesis. The filter parameters 14 that produced the minimum cost are then used as the filter parameters to define filter 10 for use in subsequent source-filter model synthesis.

Figure 2:
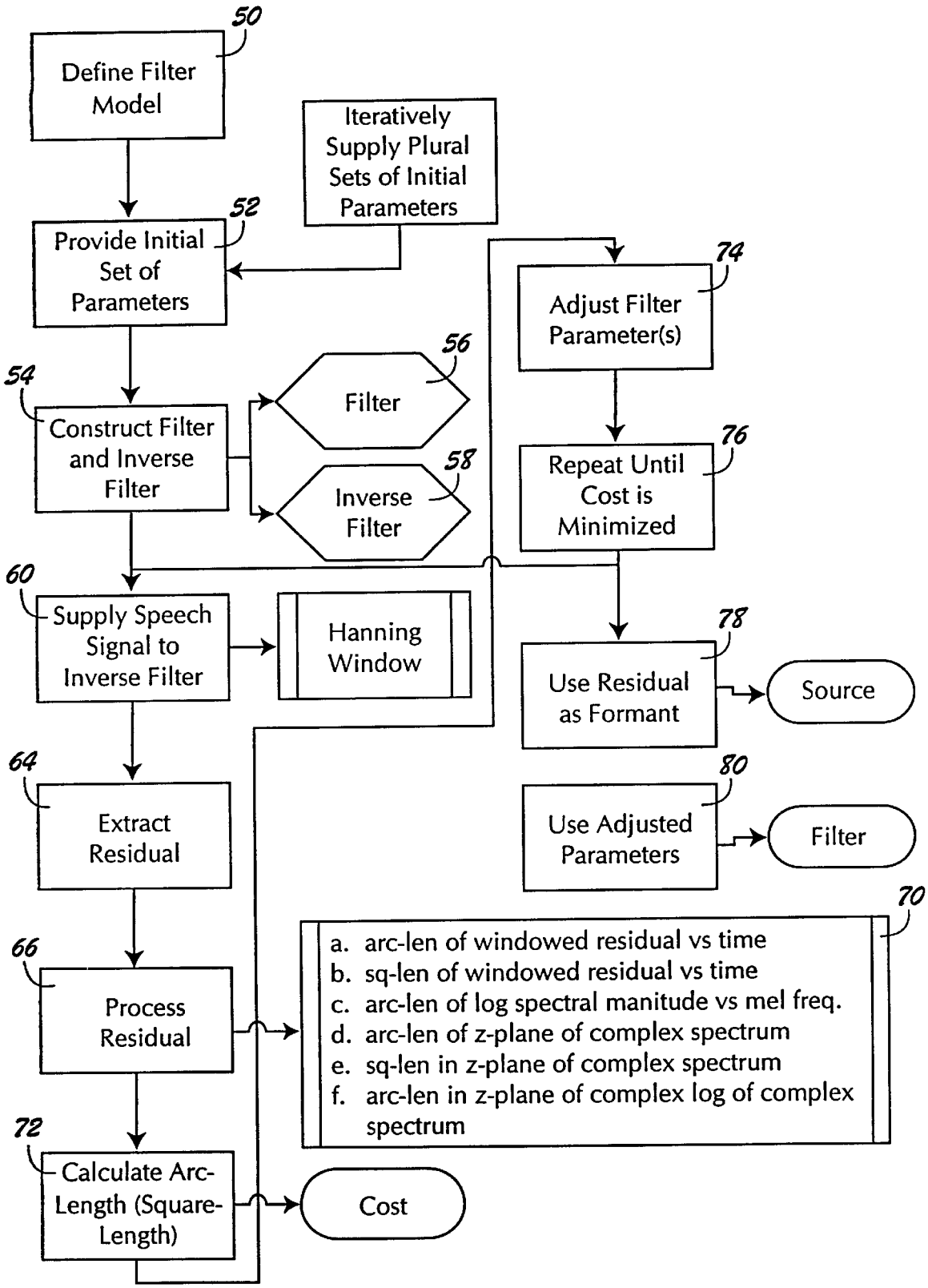
FIG. 2 is a flowchart diagram illustrating the process in accordance with the invention.

FIG. 2 illustrates the process by which the formant signal is extracted, and the filter parameters identified, to achieve a source-filter model synthesis system in accordance with the invention.

First a filter model is defined at step 50. Any suitable filter model that lends itself to a parameterized representation may be used. An initial set of parameters is then supplied at step 52. Note that the initial set of parameters will be iteratively altered in subsequent processing steps to seek the parameters that correspond to a minimized cost function. Different techniques may be used to avoid a sub-optimal solution corresponding to a local minima. For example, the initial set of parameters used at step 52 can be selected from a set or matrix of parameters designed to supply several different starting points in order to avoid the local minima. Thus in FIG. 2 note that step 52 may be performed multiple times for different initial sets of parameters.

The filter model defined at 50 and the initial set of parameters defined at 52 are then used at step 54 to construct a filter (as at 56) and an inverse filter (as at 58).

Next, the speech signal is applied to the inverse filter at 60 to extract a residual signal as at 64. As illustrated, the preferred embodiment uses a Hanning window centered on the current pitch epoch and adjusted so that it covers two-pitch periods. Other windows are also possible. The residual signal is then processed at 66 to extract data points for use in the arc-length calculation.

The residual signal may be processed in a number of different ways to extract the data points. As illustrated at 68, the procedure may branch to one or more of a selected class of processing routines. Examples of such routines are illustrated at 70. Next the arc-length (or square-length) calculation is performed at 72. The resultant value serves as a cost parameter.

After calculating the cost parameter for the initial set of filter parameters, the filter parameters are selectively adjusted at step 74 and the procedure is iteratively repeated as depicted at 76 until a minimum cost is achieved.

Once the minimum cost is achieved, the extracted residual signal corresponding to that minimum cost is used at step 78 as the source signal. The filter parameters associated with the minimum cost are used as the filter parameters (step 80) in a source-filter model.

FURTHER DETAILS OF PREFERRED EMBODIMENT

The input speech waveform data may be analyzed in frames using a moving window to identify successive frames. Use of a Hanning window for this purpose is presently preferred. The Hanning window may be modified to be asymmetric. It is centered on the current pitch epoch and reaches zero at adjacent pitch epochs, thus covering two pitch periods. If desired, an additional linear multiplicative component may be included to compensate for increasing or decreasing amplitude in the voiced speech signal.

The iterative procedure used to identify the minimum cost can take a variety of different approaches. One approach is an exhaustive search. Another is an approximation to an exhaustive search employing a steepest descent search algorithm. The search algorithm should be constructed such that local minima are not chosen as the minimum cost value. To avoid the local minima problem several different starting points may be selected and run iteratively until a solution is reached. Then, the best solution (lowest cost value) is selected. Alternatively, or in addition, heuristic smoothing algorithms may be used to eliminate some of the local minima. These algorithms are described more fully below.

A Class of Cost Functions

Figure 3:
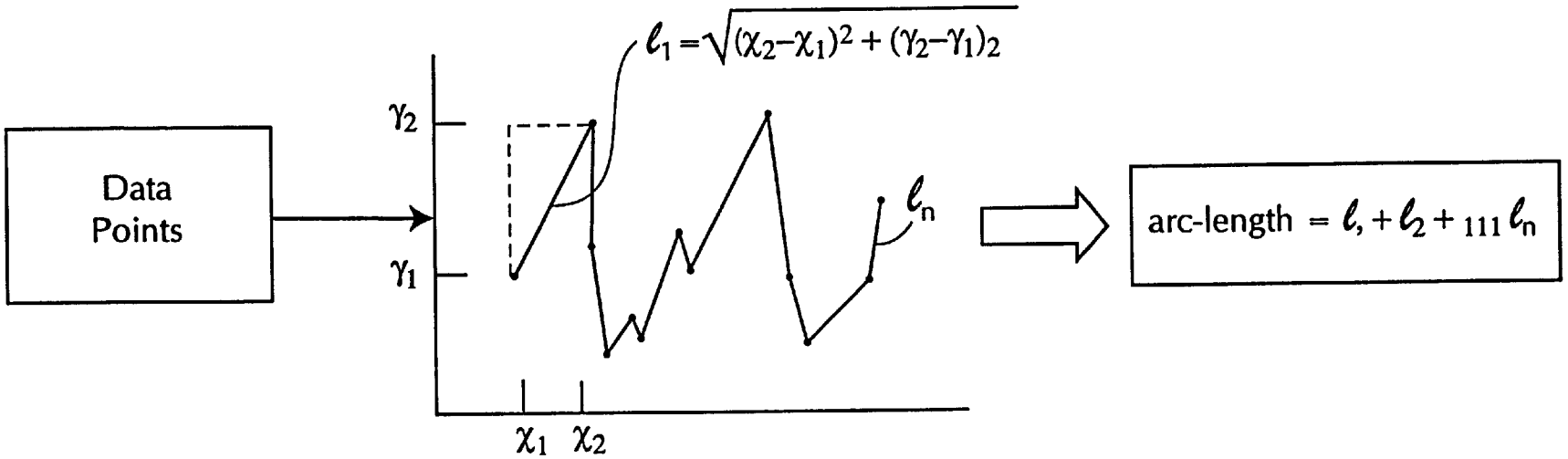
FIG. 3 is a waveform diagram illustrating the arc-length calculation applied to an exemplary residual signal.

One or more members of a class of cost functions can be used to discover the residual signal that best represents the source signal. Common to the family or class of cost functions is a concept we term "arc-length." Arc-length corresponds to the length of the line that may be drawn to represent the waveform in multi-dimensional space. The residual signal may be processed by a number of different techniques (described below) to extract a set of data points that represent a curve. This representation consists of a sequence of points which define a series of straight-line segments that give a piecewise linear approximation of the curve. This is illustrated in FIG. 3. The curve may also be represented using spline approximations or curved lines. (The term arc-length is not intended to imply that segments are curved lines only.) The arc-length calculation involves calculating the sum of the plural segment lengths to thereby determine the length of the line. The presently preferred embodiment uses a Pythagorean calculation to measure arc-length. Arc-length may be thus calculated using the following equation:

$$\text{arc-length} = \sum_{n=1}^{N} \sqrt{(x_n - x_{n-1})^2 + (y_n - y_{n-1})^2}$$

Alternatively, the term arc-length as used herein can include the square length:

$$\text{square-length} = \sum_{n=1}^{N} \{(x_n - x_{n-1})^2 + (y_n - y_{n-1})^2\}$$

In the above equations $(x_n, y_n)$ is a sequence of data points.

There exists a class of cost functions, based on arc-length, that may be used to extract a formant signal. Members of the class include:

(1) arc-length of windowed residual waveform versus time;

(2) square length of windowed residual waveform versus time;

(3) arc-length of log spectral magnitude of windowed residual versus mel frequency;

(4) arc-length in z-plane of complex spectrum of windowed residual, parameterized by frequency;

(5) square length in z-plane of complex spectrum of windowed residual, parameterized by frequency;

(6) arc-length in z-plane of complex log of the complex spectrum of windowed residual, parameterized by frequency.

Although six class members are explicitly discussed here, other implementations involving the arc-length or square length calculation are also envisioned.

The last four above-listed members are computed in the frequency domain using an FFT of adequate size to compute the spectrum. For example, for above member 6, if $Y_n = R_n * \exp(j*\theta_n)$ is the FFT of size N, $$\text{cost} = \sum_{n=1}^{N} \sqrt{\log^2\left(\frac{R_n}{R_{n-1}}\right) + (\theta_n - \theta_{n-1})^2}$$

In cost functions that include the log magnitude spectrum, smoothing can eliminate some problems with local minima, by eliminating the effects of harmonics or sharp zeros. A suitable smoothing function for this purpose may be a 3, 5, and 7 point FIR, LPC and Cepstral smoothing, with heuristic smoothing to remove dips. The smoothing function may be implemented as follows: in 3, 5 or 7 point windows in the log magnitude spectrum, low values are replaced by the average of two surrounding higher points, or if the higher points did not exist the target point is left unchanged.

The procedures described above for extracting formant signals are inherently pitch synchronous. Hence an initial estimate of pitch epochs is required. In applications where the target is text-to-speech synthesis, it may be desirable to have a very accurate pitch epoch marking in order to perform subsequent prosodic modification. We have found that the above-described methods work well in pitch extraction and epoch marking.

Specifically, pitch tracking may best be performed by applying an arc-length of windowed residual waveform versus time (1) with the constraint that the filter output is normalized so that the maximum magnitude is constant. This smoothes out the residual waveform, but maintains the size of the pitch peak. The autocorrelation can then be applied, and is less likely to suffer from higher harmonics.

The residual peak waveform is sometimes a consistent approximation to the pitch epoch, however, often this pitch is noisy or rough, causing inaccuracies. We have discovered that when the inverse filter was successful in canceling the formants, the phase of the residual approached a linear phase (at least in the lower frequencies). If the original of the FFT analysis is centered on the approximate epoch time, the phase becomes nearly flat.

Taking advantage of this, the epoch point may become one of the parameters in the minimization space when the cost function includes phase. The cost functions (3), (4) and (5) listed above include phase. Hence in these cases the epoch time may be included as a parameter in the optimization. This yields very consistent epoch marking results provided the speech signal is not too low. In addition, the accuracy of estimating formant values for the frequency domain cost functions can be greatly improved by simultaneous optimization of the pitch epoch point and corresponding alignment of the analysis window.

Some of the cost functions, such as cost function (5) lend themselves to analytical solutions. For example, cost function 5 with linear constraint on the filter coefficients may be solved analytically. Likewise, an approximate analytic solution may be found using function (4). This may be important in some applications for gaining speed and reliability.

For the case of cost function (5) define $$P_{i,j} = \sum_{k=0}^{N-1} x_{k-i} \cdot x_{k-j} \cdot \left(1 - \cos\left(\frac{2\pi(k - cntr)}{N}\right)\right)$$

Where $X_n$ is the residual waveform, M is the order of analysis, N is the size in points of the analysis window, and cntr is the estimated pitch epoch sample point index.

Then if $A_i$ is the sequence of inverse filter coefficients, and $B_i$ is a sequence of constants defining a linear constraint on the coefficients $A_i$, such that $B_0{}^*A_0 + \ldots + B_M{}^*A_M = 1$, then $A_i$ can be solved in the following matrix equation:

$$\begin{bmatrix} B_0 B_1 B_2 \ldots B_M \\ \\ P_{in} - B_j * P_{o,n} \\ \text{for } j = 1, \ldots M \end{bmatrix} \begin{bmatrix} A_0 \\ A_1 \\ \\ A_M \end{bmatrix} = \begin{bmatrix} 1 \\ 0 \\ \\ 0 \end{bmatrix}$$

Setting $B_i$=1 for i=0, . . . M gives a constraint (A). Setting $B_i$=1, and $B_i$=0 for i=1, . . . M gives constraint (B).

To find an approximate solution for cost function (4) in the above matrix equation, replace $P_i$,j by:

$$P_{i,j} = \sum_{k,l=0}^{N-1} \left\{ x_{k-i} \cdot x_{i-j} \cdot \cos\left(\pi \frac{k-l}{N}\right) - \cos\left(\pi \frac{k+l-2.cntr}{N}\right) \right\} \cdot S_{k-l} \Bigg\}$$

where:

$$S_m = \sum_{n=0}^{N/2-1} \left\{ (n+1)^a \cdot \cos\left(2\pi \frac{(n+0.5)m}{N}\right) \right\}$$

In this equation, the term, $(n+1)^\Lambda$, represents an idealized source. When alpha equals zero, the equation reduces to that of cost function (5). Setting $\Lambda$=2 gives approximately equivalent results to cost function (4).

The foregoing method focuses on the effect of a resonances filter on an ideal source. An ideal source has linear phase and a smoothly falling spectral envelope. When such an ideal source is applied to a resonance filter, the filter causes a circular detour in the otherwise short path of the complex spectrum. The arc-length minimization technique aims at eliminating the detour by using both magnitude and phase information. This is why the frequency domain cost functions work well. In comparison, conventional LPC assumes a white source and tries to flatten the magnitude spectrum. However it does not take phase into account and thus it predicts resonances to model the source characteristics.

Perhaps one of the most powerful cost functions is to employ both magnitude and phase information simultaneously. To utilize simultaneous magnitude and phase information in a frequency domain cost function, we make some further assumptions about the filter. We assume that the filter is a cascade of poles and zeros (second order resonances and anti-resonances). This is a reasonable assumption because an ideal tube has the acoustics of a cascade of poles, while a tube with a sideport (such as the nasal cavity) can be modeled by adding zeros to the cascade.

Designing the cost function to utilize both magnitude and phase information involves consideration of how a single pole will affect the complex spectrum (Fourier transform) of an ideal source which is assumed to have a near flat, near linear phase and a smooth, slowly falling magnitude with a fundamental far below the pole's frequency. The cost function should discourage the effects of the pole.

If we consider the trajectory of the complex spectrum, proceeding from zero frequency to the limiting bandwidth, we find that it takes a circuitous path that is dependent upon the waveform. If the waveform is of an ideal source, the path is fairly simple. It starts near the origin on the real access and moves quickly, in a straight line, toward a point whose distance reflects the strength of the fundamental. Thereafter it returns fairly slowly, in a straight line back towards the origin. When a single pole is applied to the source, the trajectory takes a detour into a clockwise circular path and then continues on. This detour is in agreement with the known frequency response of a pole. As the strength of the pole increases (i.e., narrower bandwidth) the size of the circular detour gets larger. Again, the arc-length may be applied to minimize the detour and thus improve the performance of the cost function. A cost function based on the arc-length of the complex spectrum in the Z-plane, parameterized by frequency thus serves as a particularly beneficial cost function for analyzing formants.

Two other cost functions of the same type have also been found to have excellent results. The first is defined by adding up the square-distance of each step as the spectrum path is traversed. This is actually computationally simpler than some other techniques, because it does not require a square root to be taken. The second of these cost functions is defined by taking the logarithm of the complex spectrum and computing the arc-length of that trajectory in the Z-plane. This cost function is more balanced in its sensitivity to poles and zeros.

All of the foregoing "spectrum path" cost functions appear to work very well. Because they have varying features, one or another may prove more useful for a specific application. Those that are amenable to analytic mathematical solution may represent the best choice where computation speed and reliability is required.

Figure 4A:
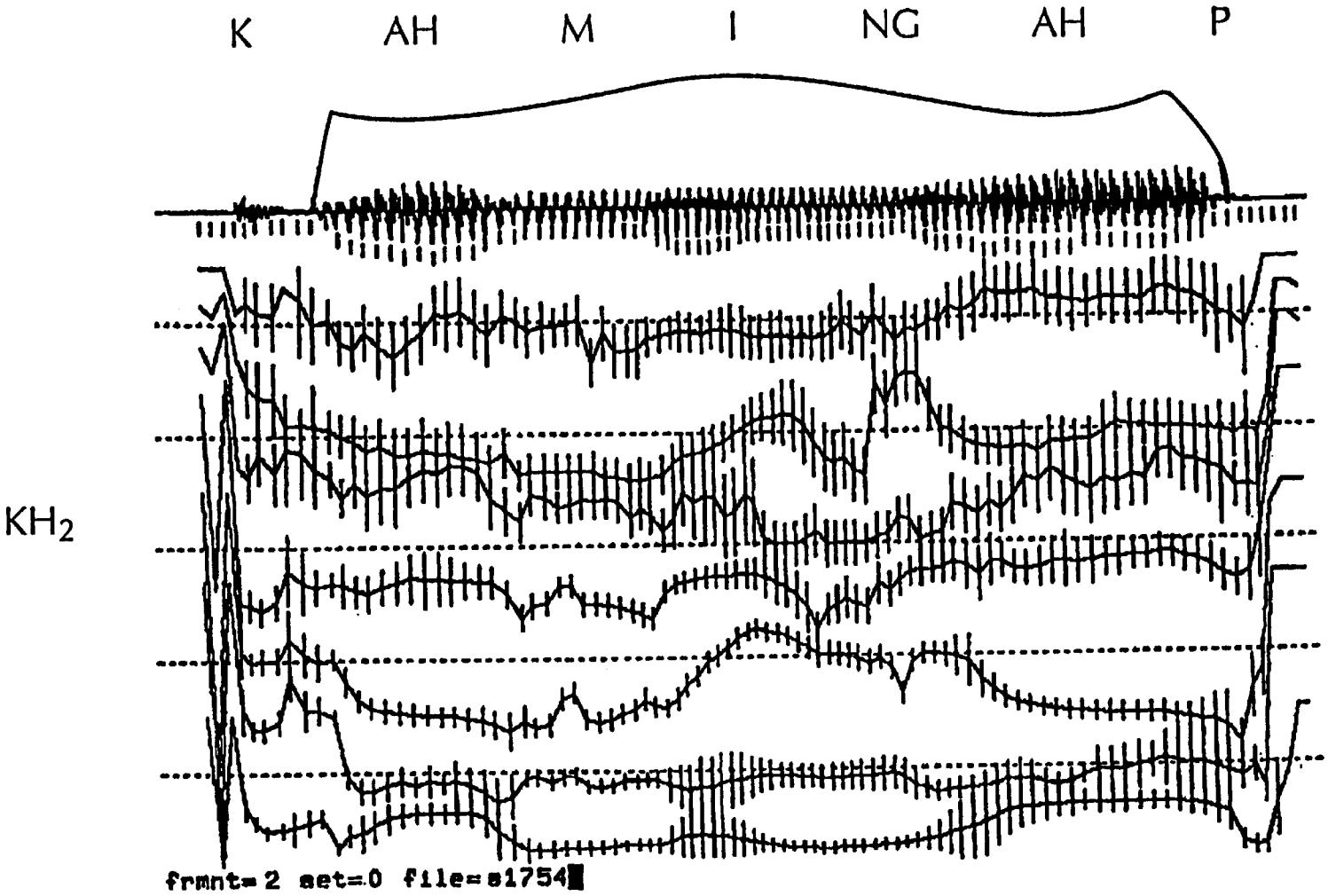
FIG. 4*a* illustrates the result of a length-squared cost function on an exemplary spoken phrase, illustrating derived formant frequencies versus time.

FIG. 4*a* shows the result of the length-squared cost function on the phrase "coming up." This is a plot of derived formant frequencies versus time. Also, the bandwidth are included as the length of the small crossing lines. Notice there are no glitches or filter shifts such as usually appear in LPC analysis.

Figure 4B:
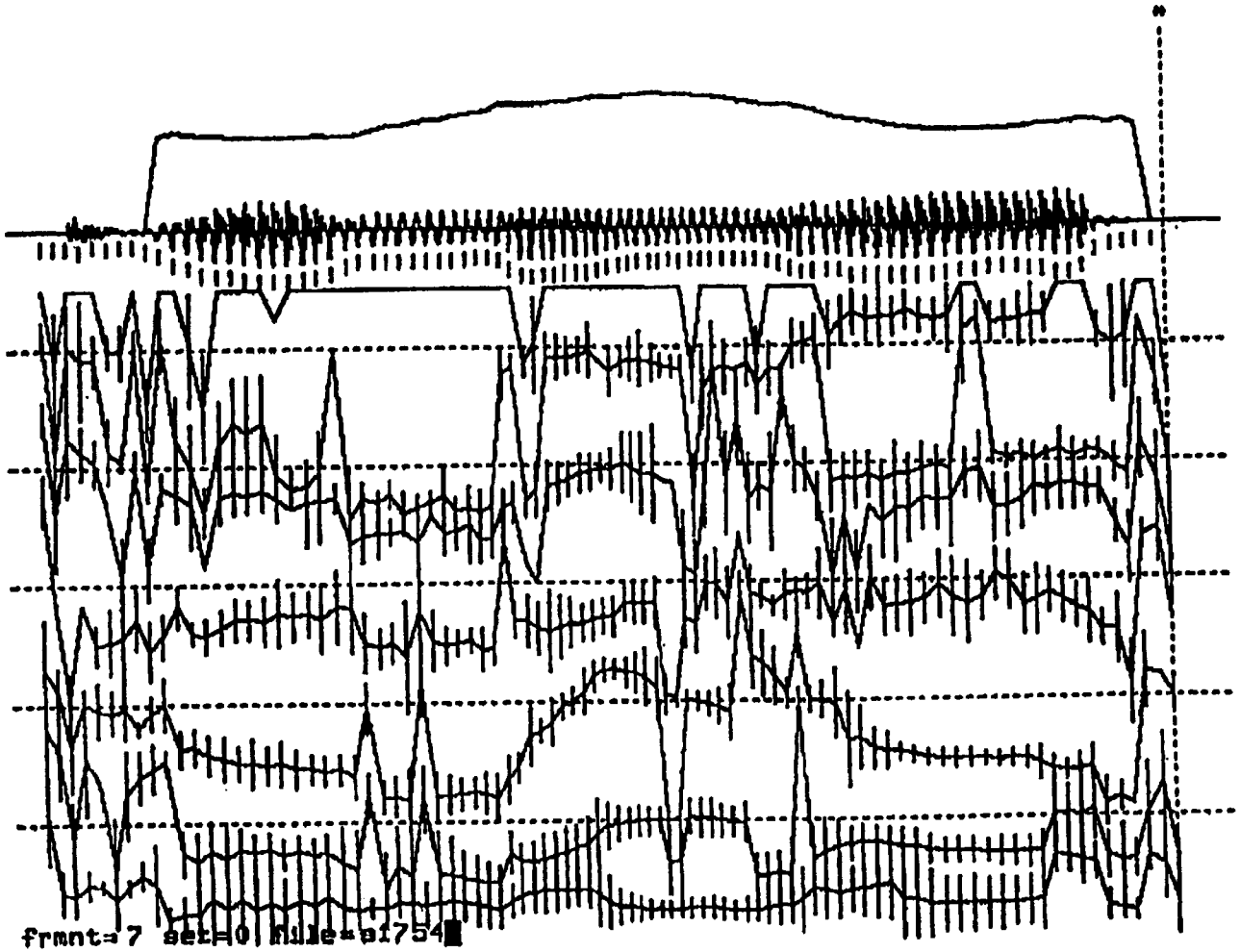
FIG. 4b (Prior Art)
FIG. 4*b* illustrates the result achieved using conventional linear predictive coding (LPC) upon the exemplary phrase employed in FIG. 4*a;*

The same phrase, analyzed using LPC, is shown in FIG. 4*b*. In each plot, the waveform is shown at the top and the plot above the waveform is the pitch which is extracted using the inverse filter with autocorrelation.

Figure 5:
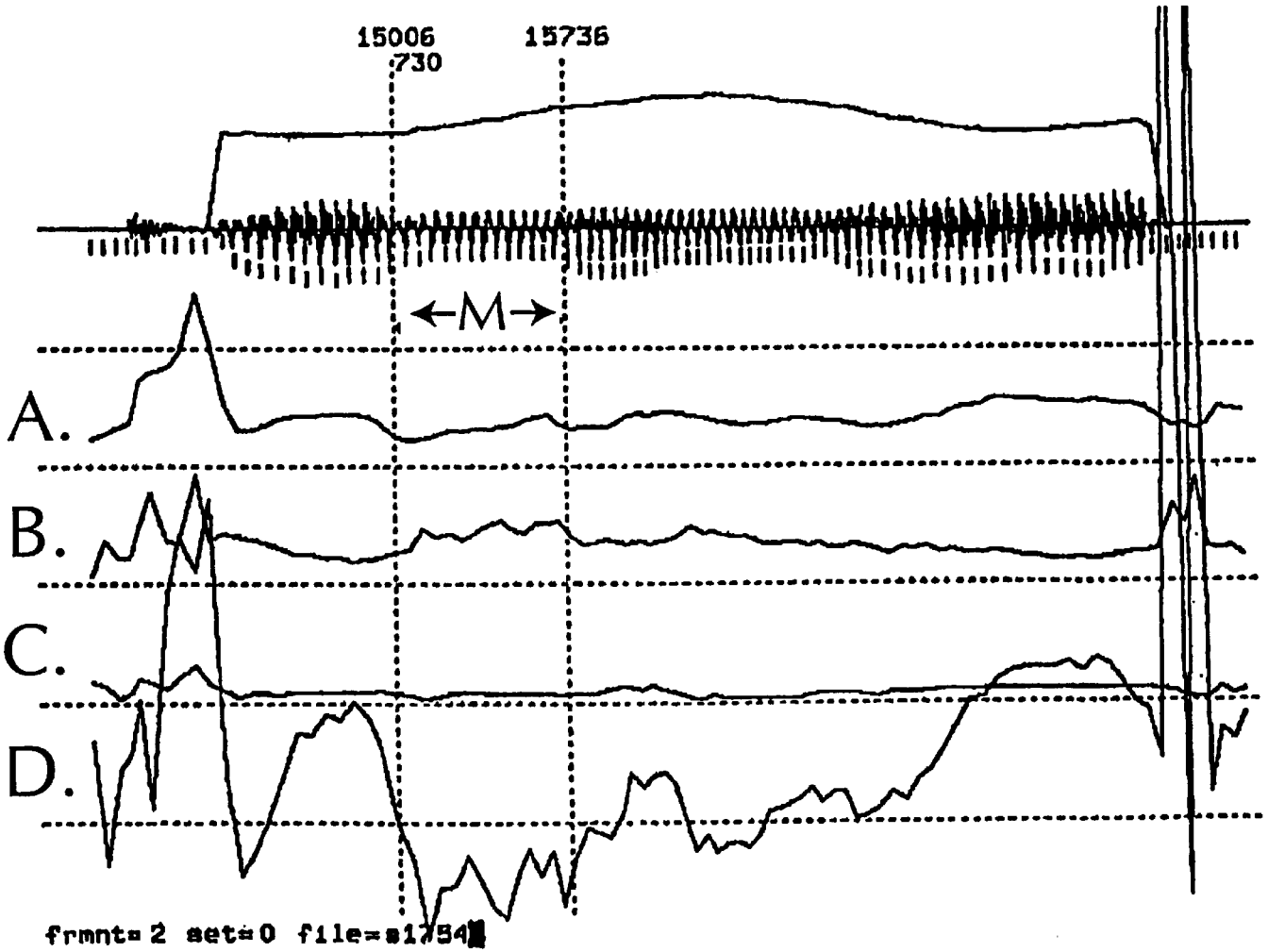
FIG. 5 illustrates several discriminatory functions on separately labeled lines, line A depicting the average arc-length of the time domain waveform, line B depicting the average arc-length of the inverse filtered waveform, line C illustrating the zero-crossing rate, line D illustrating the scaled up difference of parameters shown on lines A and B.

FIG. 5 shows several discriminatory functions. Function (A) is the average arc-length of the time domain waveform. Function (B) is the average arc-length of the inverse filtered waveform. Function (C) illustrates the zero crossing rate (a property not directly applicable here, but shown for completeness). Function (D) is the scaled-up difference of parameters (A) and (B). The difference function (D) appears to take a low or negative value, depending on how constricted the articulators are. In particular, note that during the "m" contained within the phrase "coming up" the articulators are constricted. This feature can be used to detect nasals and the boundaries between nasals and vowels.

A kind of prefiltering was developed for analysis which significantly increased the accuracy, especially of pitch epoch marking. This is applied when the analysis uses a non-logarithmic cost function in the frequency domain. In that case, the analysis is very sensitive at low frequencies, and hence we were finding disturbances from a puff of air or other low frequency sources. Simple high pass filtering with FIR filters seemed to make things worse.

The following solution was implemented: During optimization of a cost function, the original speech waveform, windowed on two glottal pulses, is repeatedly inverse filtered. The input waveform, x[n], is modified by subtracting a polynomial in n, A*n*n+B*n+C, where n=0 is the epoch point and also the origin of the FFT used on the cost function. This means we assume the low frequency distortion is approximated by an additive polynomial waveform over the two period window. To find A,B,C, these are included in the optimization with the goal of minimizing the cost function. A way was found to not incur too much additional computation. The result was a high-pass effect which improved analysis and epoch marking in low-amplitude parts of the waveform.

Performance Evaluation

To evaluate accuracy, two spectral distance measures were implemented, and a comparison test was run on synthetic speech. The first measure is based on the distance, in the z-plane, between the target pole and the pole that was estimated by the analysis method. The distance was calculated separately for formants one through four, and also for the sum of all four, and was accumulated over the whole test utterance.

The second measure is the (spectral peak sensitive) Root-Power Sums (RPS) distortion measure, defined by $$dist = \sum_{k=1}^{N} (k \cdot (cl_k - c2_k))^2$$

where $cl_k$ and $c2_k$ are the kth cepstral coefficient of the target spectrum and analyzed spectrum respectively, and N was chosen large enough to adequately represent the log spectrum.

The analysis was performed on a completely voiced sentence, "Where were you a year ago?" which was produced by a rule based formant synthesizer. Several words were emphasized to cause a fairly extreme intonation pattern. The formant synthesizer produced six formants, and each analysis method traced six, however, only the first four formants were considered in the distance measures. The known formant parameters from the synthesizer served as the target values.

For reference, the sentence was analyzed by standard LPC of order 16, using the autocorrelation estimation method. The LPC was done pitch synchronously, similar to the other methods and the window was a Hanning window centered on two pitch periods. Formant modeling poles were separated from source modeling poles by selecting the stronger resonances (i.e. narrower bandwidths). The LPC analysis made several discontinuity errors, but for the accuracy measurements, these errors were corrected by hand by reassigning formants.

Any combination of cost function and filter constraint can be used for analysis, however, some of these combinations give very poor results. The non-productive combinations were eliminated from consideration. Combinations that performed fairly well as listed in Table 1, to be compared with themselves and LPC. The scale or units associated with these numbers is arbitrary, but the relative values within a column are comparable.

TABLE 1

Error measurement of analysis methods.
Methods are named by cost-function number and constraint letter.

| | 1 | 2 | 3 | 4 | sum | RPS |
|---|---|---|---|---|---|---|
| LPC | 3.57 | 3.24 | 2.93 | 3.63 | 13.4 | 17.6 |
| 1C | 9.32 | 5.45 | 4.73 | 5.07 | 24.6 | 81.1 |
| 1A | 4.51 | 5.86 | 5.63 | 7.03 | 23.0 | 38.7 |
| 2A | 11.80 | 11.08 | 6.56 | 9.54 | 39.0 | 115.0 |
| 3A | 2.12 | 2.43 | 1.81 | 2.07 | 8.4 | 12.2 |
| 4A | 1.26 | 2.37 | 2.32 | 2.83 | 8.8 | 11.1 |
| 4B | 3.22 | 7.82 | 4.98 | 4.13 | 20.2 | 46.7 |
| 5A | 1.57 | 4.13 | 4.27 | 8.30 | 18.3 | 24.8 |
| 6A | 1.23 | 2.88 | 2.51 | 2.84 | 9.5 | 7.6 |

Assuming that these distance measures are valid, we conclude generally that the cost functions based in the frequency domain and using the DC unity gain constraint outperform LPC in accuracy. Especially noticeable is their improvement to accuracy in the first formant.

One might conclude that methods (3A), (4A), and (6A) are equally likely candidates for an analysis application, however, there are further factors to be considered. This concerns local minima and convergence. Methods (3A) and (6A), which involve the logarithm, are much more likely to encounter local minima and converge more slowly. This is unfortunate since these are the most likely to also track zeros.

Methods (4A) and (5A) rarely encounter local minima, in fact, no local minima has yet been observed for method (5A). On the other hand, these methods tend to estimate overly narrow bandwidths. Hence, for these, a small penalty was added to the cost function to discourage overly narrow bandwidths. Although method (5A) is inferior overall, it may be very useful since it accurately tracks formant one with faster convergence and no local minima.

While the invention has been described in its presently preferred embodiment, it will be understood that the invention is capable of certain modification without departing from the spirit of the invention as set forth in the appended claims.

What is claimed is:

1. A method for extracting a formant-based source signals and filter parameters from a speech signal, comprising:

a. defining a filter model of the type having an associated set of filter parameters;

b. providing a first filter based on said filter model;

c. supplying said speech signal to said first filter to generate a residual signal;

d. processing said residual signal to extract a set of data points that define a line of plural segments and calculating a length measure of said line to thereby determine a cost parameter associated with said residual signal;

e. selectively adjusting said filter parameters to produce a resulting reduction in said cost parameter;

g. iteratively repeating steps c–e until said cost parameter is minimized and then using said residual signal to represent an extracted source signal and filter parameters.

2. The method of claim 1 further comprising providing a second filter corresponding to the inverse of said first filter for use in processing said extracted source signal to generate synthesized speech.

3. The method of claim 1 wherein said step d is performed by extracting time domain data from said residual signal.

4. The method of claim 1 wherein said step d is performed by extracting time domain data from said residual signal and calculating the square length of the distance across said time domain data.

5. The method of claim 1 wherein said step d is performed by extracting the log spectral magnitude of said residual signal in the frequency domain.

6. The method of claim 1 wherein said step d is performed by extracting the z-plane complex spectrum of said residual signal parameterized by frequency.

7. The method of claim 1 wherein said step d is performed by extracting the z-plane complex log of the complex spectrum of said residual signal parameterized by frequency.

8. A method for extracting a formant-based source signals and filter parameters from a speech signal, comprising:

a. defining a filter model of the type having an associated set of filter parameters;

b. further defining said filter model to represent an all pole filter having a plurality of associated filter coefficients and applying a linear constraint on said filter coefficients;

c. defining a cost function P as the length or square length of the z-plane complex spectrum of a residual signal parameterized by frequency;

d. minimizing said cost function to yield a set of filter parameters; and e. using said filter parameters to define a filter and using said defined filter to generate a set an extracted source.

* * * * *